US011837125B2

(12) United States Patent
Zhang et al.

(10) Patent No.: US 11,837,125 B2
(45) Date of Patent: Dec. 5, 2023

(54) DISPLAY PANEL, METHOD FOR DETECTING DISPLAY PANEL AND ELECTRONIC DEVICE

(71) Applicants: Ordos Yuansheng Optoelectronics Co., Ltd., Inner Mongolia (CN); BOE Technology Group Co., Ltd., Beijing (CN)

(72) Inventors: Qianqian Zhang, Beijing (CN); Liangliang Liu, Beijing (CN); Liman Peng, Beijing (CN); Zhiyong Xue, Beijing (CN); Le Gao, Beijing (CN)

(73) Assignees: Ordos Yuansheng Optoelectronics Co., Ltd., Inner Mongolia (CN); BOE Technology Group Co., Ltd., Beijing (CN)

( * ) Notice: Subject to any disclaimer, the term of this patent is extended or adjusted under 35 U.S.C. 154(b) by 28 days.

(21) Appl. No.: 17/531,247

(22) Filed: Nov. 19, 2021

(65) Prior Publication Data

US 2022/0172654 A1 Jun. 2, 2022

(30) Foreign Application Priority Data

Nov. 27, 2020 (CN) ..... 202011359648.X

(51) Int. Cl.
*G09G 3/00* (2006.01)

(52) U.S. Cl.
CPC ..... *G09G 3/006* (2013.01); *G09G 2300/0443* (2013.01); *G09G 2310/08* (2013.01);
(Continued)

(58) Field of Classification Search
None
See application file for complete search history.

(56) References Cited

U.S. PATENT DOCUMENTS

2010/0141293 A1 6/2010 Chen et al.
2016/0225336 A1 8/2016 Gu et al.
(Continued)

FOREIGN PATENT DOCUMENTS

CN 104575429 A 4/2015
CN 104766580 A 7/2015
(Continued)

OTHER PUBLICATIONS

CN202011359648.X first office action.

*Primary Examiner* — Andre L Matthews
(74) *Attorney, Agent, or Firm* — IPro, PLLC

(57) ABSTRACT

A display panel, a method for detecting a display panel and an electronic device are provided. a display panel are provided, including a display area and a peripheral region surrounding the display area; a plurality of bonding pads in the peripheral region; a lighting pad in the peripheral region; a plurality of source signal lines at least in the display region; a plurality of source signal line leads in the peripheral region and electrically connected to the plurality of source signal lines and electrically connected to the plurality of bonding pads; a plurality of sub-pixel columns in the display region and electrically connected to the plurality of source signal lines; and a detection circuit, arranged in the peripheral region and between the plurality of binding pads and the display area.

5 Claims, 6 Drawing Sheets

(52) U.S. Cl.
CPC ..... *G09G 2330/02* (2013.01); *G09G 2370/20* (2013.01); *G09G 2370/22* (2013.01)

(56) References Cited

U.S. PATENT DOCUMENTS

| | | | | |
|---|---|---|---|---|
| 2016/0260367 | A1* | 9/2016 | Kwak | G09G 3/3291 |
| 2016/0314850 | A1 | 10/2016 | Gu et al. | |
| 2018/0146578 | A1* | 5/2018 | Lee | G02F 1/13452 |
| 2020/0265787 | A1 | 8/2020 | Im et al. | |
| 2021/0375173 | A1 | 12/2021 | Wang et al. | |

FOREIGN PATENT DOCUMENTS

| | | | |
|---|---|---|---|
| CN | 106990635 | A | 7/2017 |
| CN | 107219701 | A | 9/2017 |
| CN | 111583842 | A | 8/2020 |
| CN | 111785658 | A | 10/2020 |
| KR | 20200102020 | A | 8/2020 |
| TW | M357609 | U | 5/2009 |

* cited by examiner

DISPLAY PANEL, METHOD FOR DETECTING DISPLAY PANEL AND ELECTRONIC DEVICE

CROSS-REFERENCE TO RELATED APPLICATION

The present disclosure claims priority to Chinese Patent Application No. 202011359648.X filed in China on Nov. 27, 2020, the disclosure of which is hereby incorporated by reference in its entirely.

TECHNICAL FIELD

The present disclosure relates to the field of display, and in particular, to a display panel, a method for detecting a display panel and an electronic device.

BACKGROUND

In the related art, a small-sized watch product is taken as an example of an organic light emitting diode display product, and after the small-sized watch product completes a single display screen preparation process, electronic detection needs to be performed on the small-sized watch product to screen out defective products, so that the single display screens flowing to a module process are all good products. In the design of the backboard for displaying a product in the related art, part of circuit abnormity cannot be detected in electronic detection before the control chip is bound, and badness can be detected only when the display product is subjected to final detection after a module process (namely, after the flexible circuit board and the control chip are bound), so that the waste of capacity and materials is caused.

Therefore, the display panel, the method for testing the display panel, and the electronic device still need to be improved.

SUMMARY

In a first aspect, a display panel is provided in the present disclosure, including a display area and a peripheral region surrounding the display area;

a plurality of bonding pads in the peripheral region;

a lighting pad in the peripheral region;

a plurality of source signal lines at least in the display region;

a plurality of source signal line leads in the peripheral region and electrically connected to the plurality of source signal lines and electrically connected to the plurality of bonding pads;

a plurality of sub-pixel columns in the display region and electrically connected to the plurality of source signal lines; and a detection circuit, arranged in the peripheral region and between the plurality of binding pads and the display area, where the detection circuit and the lighting pad are symmetrically distributed on two sides of the display area;

where the detection circuit includes at least one lighting data line which surrounds the display area, extends to the lighting pad and is electrically connected to the lighting pad;

the at least one lighting data line is electrically connected to at least one of the plurality of source signal line leads, and is configured to transmit a lighting signal to the at least one of the plurality of source signal line leads.

Optionally, the display panel includes: a multi-splitter circuit between the display area and the detection circuit, and electrically connected to at least two of the plurality of source signal lines and one of the plurality of source signal line leads, where the multi-splitter circuit is configured to transmit the lighting signal provided by the source signal line leads to the at least two source signal lines respectively at different periods of time.

Optionally, a direction pointing from the bonding region to the lighting pad is a first direction, the at least one lighting data line extends in a direction perpendicular to the first direction, and the plurality of source signal line leads extend in the first direction.

Optionally, the multi-splitter circuit includes a first sub-circuit connected to the sub-pixel columns in odd columns and a second sub-circuit connected to the sub-pixel columns in even columns.

Optionally, the at least one lighting data line includes a first lighting data line, a second lighting data line and a third lighting data line, the first lighting data line, the second lighting data line and the third lighting data line are respectively electrically connected to different source signal line leads.

Optionally, the display panel further includes at least one thin film transistor, where a source of the at least one thin film transistor is electrically connected to the at least one lighting data line, and a drain of the at least one thin film transistor is electrically connected to the plurality of source signal line leads.

Optionally, the at least one lighting data line further includes a switch bus electrically connected to gates of the plurality of thin film transistors.

Optionally, the switch bus is located on a side of the gate away from a substrate, and an insulating medium is interposed between the switch bus and the gate, and the switch bus and the gate are electrically connected through a via in the insulating medium.

In a second aspect, a method for detecting a display panel hereinabove is further provided in the present disclosure, including: inputting a lighting signal from the lighting pad to the plurality of source signal lines through the detection circuit.

In a third aspect, an electronic device is further provided in the present disclosure, including a display panel;

where the display panel includes a display area and a peripheral region surrounding the display area;

a plurality of bonding pads in the peripheral region;

a lighting pad in the peripheral region;

a plurality of source signal lines at least in the display region;

a plurality of source signal line leads in the peripheral region and electrically connected to the plurality of source signal lines and electrically connected to the plurality of bonding pads;

a plurality of sub-pixel columns in the display region and electrically connected to the plurality of source signal lines; and a detection circuit, arranged in the peripheral region and between the plurality of binding pads and the display area, where the detection circuit and the lighting pad are symmetrically distributed on two sides of the display area;

where the detection circuit includes at least one lighting data line which surrounds the display area, extends to the lighting pad and is electrically connected to the lighting pad;

the at least one lighting data line is electrically connected to at least one of the plurality of source signal line leads, and is configured to transmit a lighting signal to the at least one of the plurality of source signal line leads.

Optionally, the electronic device includes: a multi-splitter circuit between the display area and the detection circuit, and electrically connected to at least two of the plurality of source signal lines and one of the plurality of source signal line leads, where the multi-splitter circuit is configured to transmit the lighting signal provided by the source signal line leads to the at least two source signal lines respectively at different periods of time.

Optionally, a direction pointing from the bonding region to the lighting pad is a first direction, the at least one lighting data line extends in a direction perpendicular to the first direction, and the plurality of source signal line leads extend in the first direction.

Optionally, the multi-splitter circuit includes a first sub-circuit connected to the sub-pixel columns in odd columns and a second sub-circuit connected to the sub-pixel columns in even columns.

Optionally, the at least one lighting data line includes a first lighting data line, a second lighting data line and a third lighting data line, the first lighting data line, the second lighting data line and the third lighting data line are respectively electrically connected to different source signal line leads.

Optionally, the electronic device further includes at least one thin film transistor, where a source of the at least one thin film transistor is electrically connected to the at least one lighting data line, and a drain of the at least one thin film transistor is electrically connected to the plurality of source signal line leads.

Optionally, the at least one lighting data line further includes a switch bus electrically connected to gates of the plurality of thin film transistors.

Optionally, the switch bus is located on a side of the gate away from a substrate, and an insulating medium is interposed between the switch bus and the gate, and the switch bus and the gate are electrically connected through a via in the insulating medium.

BRIEF DESCRIPTION OF THE DRAWINGS

The above and/or additional aspects and advantages of the present disclosure will become apparent and readily appreciated from the following description of the embodiments, taken in conjunction with the accompanying drawings of which.

DETAILED DESCRIPTION

Figure 1:
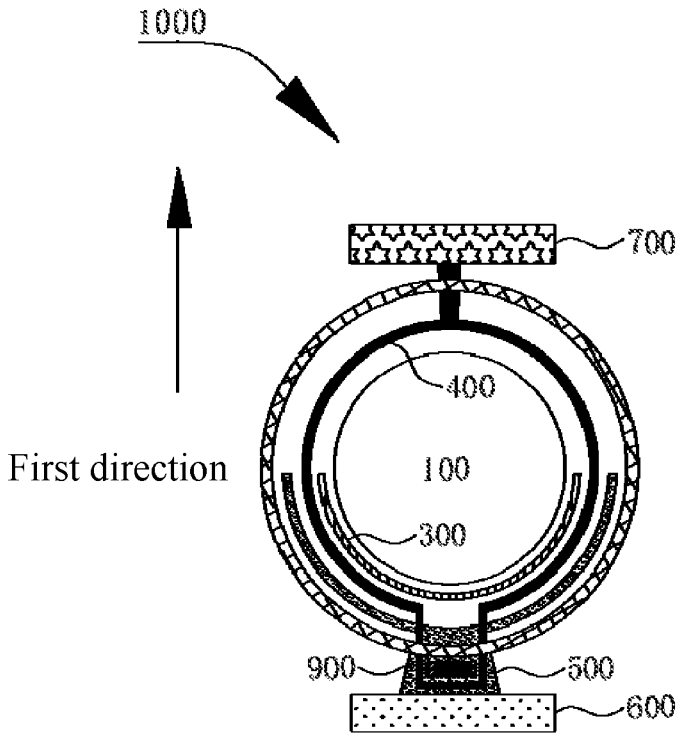
FIG. 1 shows a circuit design schematic view of a display panel according to an embodiment of the present disclosure.

Reference will now be made in detail to the embodiments of the present disclosure, examples of which are illustrated in the accompanying drawings, where like reference numerals refer to the same or similar elements or elements having the same or similar functions throughout. The embodiments described below with reference to the accompanying drawings are illustrative only for the purpose of explaining the present disclosure, and are not to be construed as limiting the present disclosure.

The present application is directed to solving, to some extent, one of the technical problems in the related art.

Figure 3:
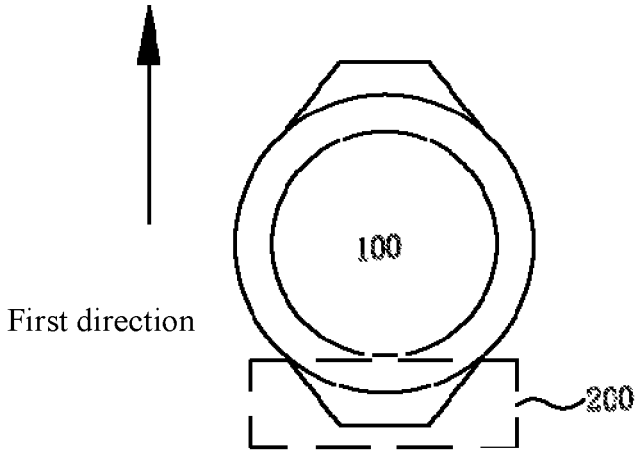
FIG. 3 is a schematic view of a partial structure of a display panel according to an embodiment of the present disclosure.
Figure 4:
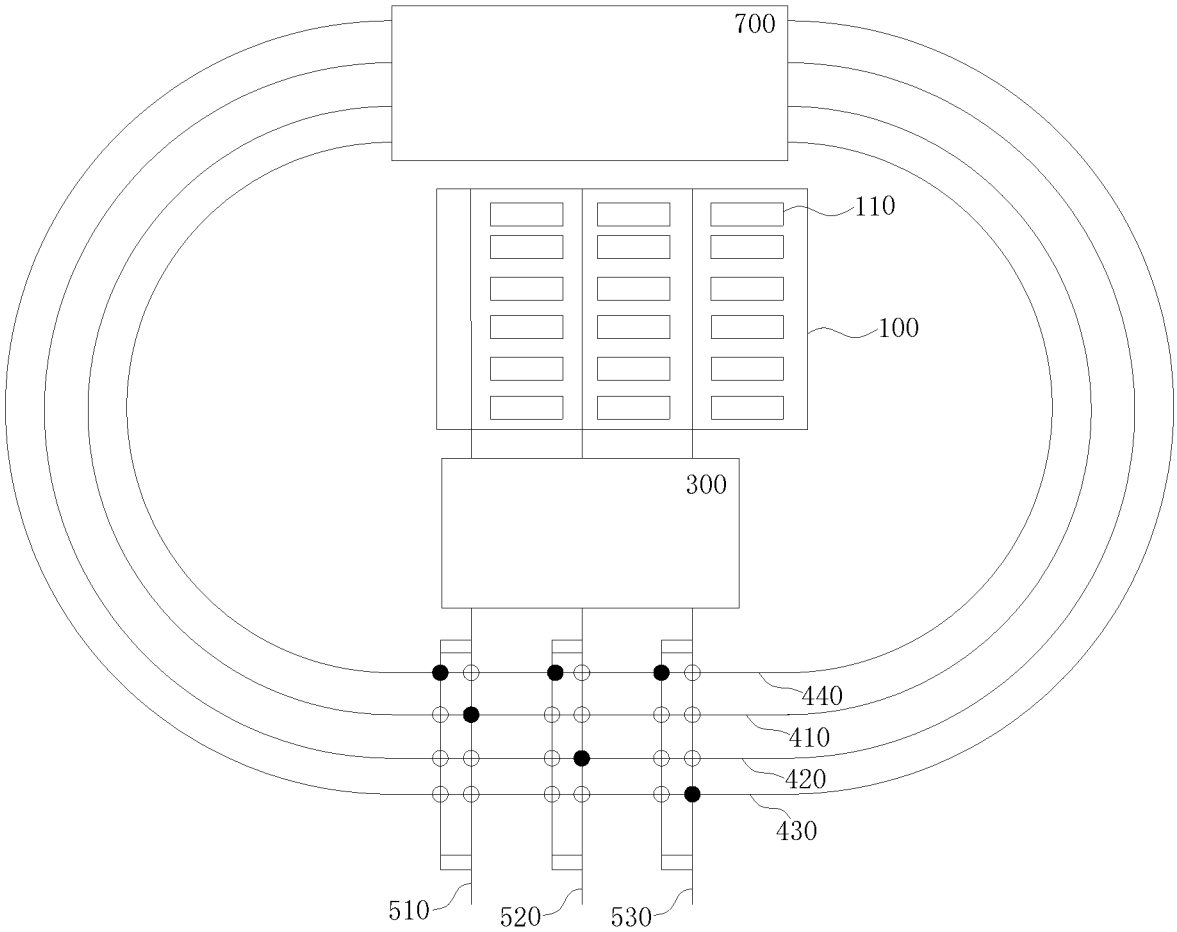
FIG. 4 is a circuit design schematic view of a detection circuit according an embodiment of the present disclosure.

In one aspect of the present disclosure, referring to FIGS. 1, 3 and 4, the present disclosure proposes a display panel 1000 including a display area 100 and a peripheral region surrounding the display area 100; a plurality of bonding pads 600, the plurality of bonding pads 600 being in the peripheral region; a lighting pad 700, the lighting pad 700 being in the peripheral region; a plurality of source signal lines at least in the display region; a plurality of source signal line leads in the peripheral region and electrically connected to the plurality of source signal lines and electrically connected to the plurality of bonding pads 600, where the source signal line leads are routed side by side in the fan-out region 500; a plurality of sub-pixel columns 110, the plurality of sub-pixel columns 110 being in the display region 100 and electrically connected to the plurality of source signal lines; the detection circuit 900, the detection circuit 900 is in the peripheral region, and is between the plurality of bonding pads 600 and the display region, and is symmetrically distributed on both sides of the display region 100 with the lighting pad 700; the detection circuit 900 has at least one lighting data line 400, and the at least one lighting data line 400 surrounds the display area 100 and extends to the lighting pad 700 to be electrically connected to the lighting pad 700; the at least one lighting data line 400 is electrically connected to at least one of the plurality of source signal line leads, and is configured to transmit a lighting signal to the at least one of the plurality of source signal line leads. The detection circuit can detect possible abnormalities of a source electrode signal line and a fan-out area of the display panel, good products and defective products with abnormal lines are screened and distinguished, and then the single display screen flowing to the module process is guaranteed to be good products, waste of productivity and materials is reduced, and the yield of finished products of the display panel is effectively improved. According to some embodiments of the present disclosure, the display panel may further include: the multi-splitter circuit 300, the multi-splitter circuit 300 being between the display area 100 and the detection circuit 900 and being electrically connected to at least two of the plurality of source signal lines and one of the plurality of source signal line leads (510, 520, and 530 as shown in the drawing), respectively, is configured to transmit the lighting signal provided by the source signal line lead to the at least two source signal lines at different periods of time, respectively. Thus, the emission performance of the display panel can be improved by collectively controlling the plurality of sub-pixel columns by the multi-splitter circuit, and the presence or absence of an abnormality in the multi-splitter circuit can be detected by the detection circuit.

It should be noted that the open circles in black in the drawings indicate that the two lines do not intersect, that is, the open circles in black indicate that the two lines do not communicate with each other, and only the orthographic projections of the two lines on the substrate intersect.

Figure 2:
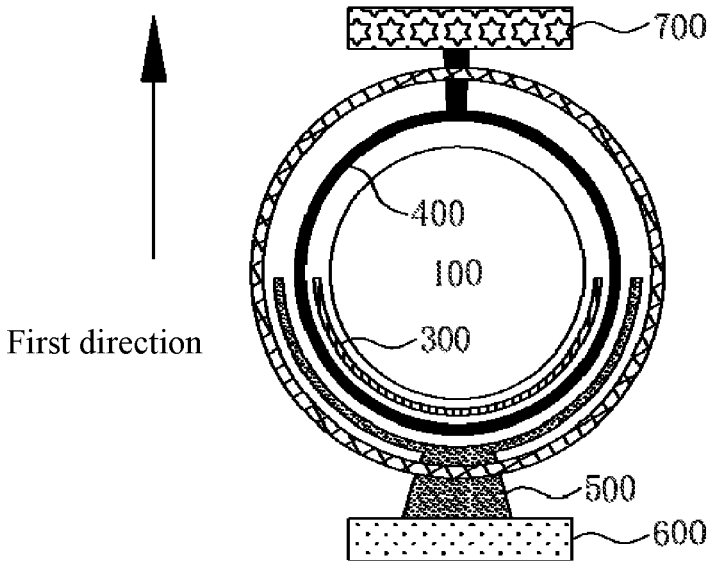
FIG. 2 is a schematic view of a circuit design of a display panel in the related art.

For ease of understanding, referring to FIG. 2, the following is a brief description of the principle that the display panel can achieve the above beneficial effects:

in the related art, a plurality of source signal lines connecting the small-sized display panel and the sub-pixel columns extend from the display area 100 to the bonding area at the periphery of the display area 100 and are connected to the multi-splitter circuit 300, and the multi-splitter circuit 300 extends to the fan-out area 500 and is connected to a plurality of ports of the flexible printed circuit board of the bonding pad 600. Therefore, one multi-splitter circuit 300 can control multiple rows of sub-pixel columns simultaneously, thereby reducing the routing difficulty of the fan-out area 500. However, in this connection manner, when the single display panel is electronically inspected before the control chip is bonded, the lighting signal can only be directly transmitted to the pixel area 100 through the lighting pad 700 to be subjected to the lighting test, and the lighting signal does not pass through the source signal line, the multi-splitter circuit, and the fan-out area. That is, the lighting test at this time cannot detect abnormalities such as electrostatic burns, short circuits, and disconnection in some or more lines in the multi-splitter circuit, the source signal line, and the fan-out area, and the abnormalities of the display panel can be detected only when the display product reaches the rear section, completes the module process, and performs final inspection through the control chip, resulting in a great waste of module productivity and materials.

Figure 5:
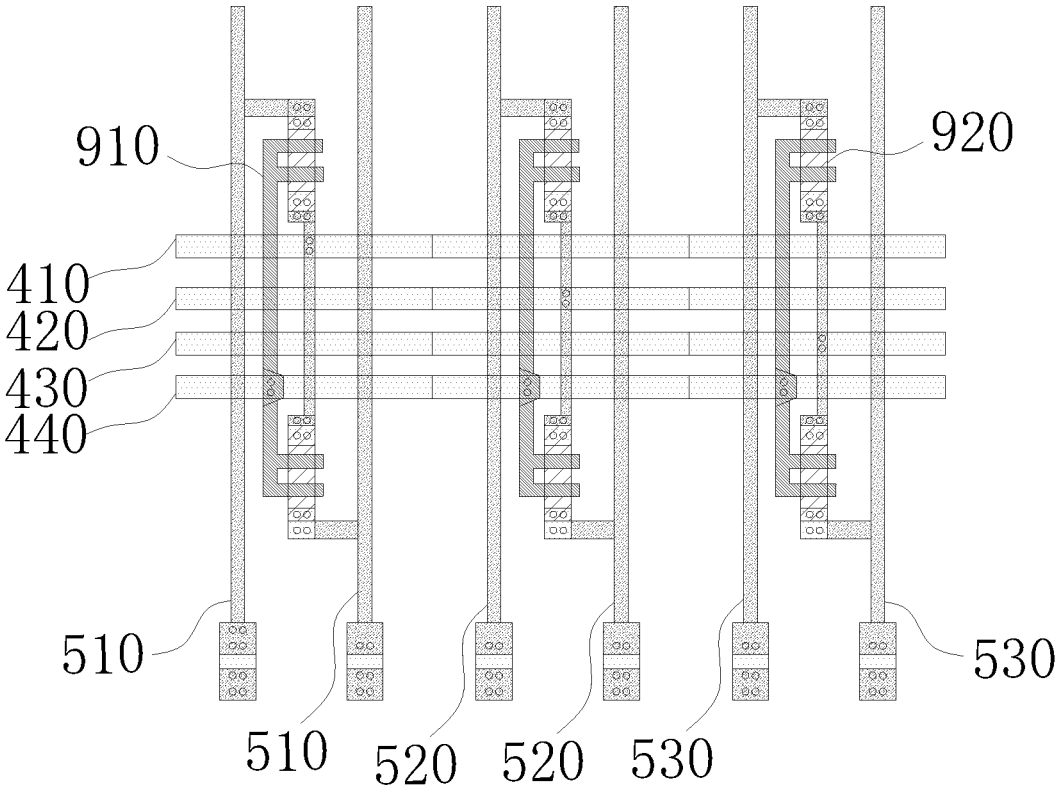
FIG. 5 is a schematic view of a partial circuit design of a detection circuit according an embodiment of the present disclosure.

In the present disclosure, referring to FIGS. 1, 4 and 5, the electronic detection circuit in the related art is optimized, and the detection circuit 900 is added to the peripheral region. The principle of realizing the detection of the multi-splitter circuit, the source signal line and the fan-out area is as follows: taking the example where the sub-pixel row includes a red sub-pixel row, a green sub-pixel row, and a blue sub-pixel row, the lighting pad 700 transmits the lighting signal to the lighting data lines, which include a first lighting data line 410, i.e., a lighting data line corresponding to the red sub-pixel row, a second lighting data line 420, i.e., a lighting data line corresponding to the green sub-pixel row, and a third lighting data line 430, i.e., a lighting data line corresponding to the blue sub-pixel row, and the lighting data lines of a specific color are connected to the same color source signal line lead wires, and finally transmit the lighting signal to the multi-splitter circuit of a corresponding color and light the sub-pixel rows of a display area corresponding color. Through the matching of the lighting signal and the time sequence of the multi-splitter circuit, the display area can display black and white gray scale and red, green and blue monochromatic pictures. Since the lighting signal passes through the multi-splitter circuit, the source signal line and the fan-out region, that is, the currents pass through the multi-splitter circuit, the source signal line and the fan-out region, the light emitting performance of the sub-pixel columns in the display region is tested, and whether the multi-splitter circuit, the source signal line and the fan-out region are short-circuited, open-circuited or burnt by static electricity is detected. The method realizes the line detection of the multi-splitter circuit, the source electrode signal line and the fan-out area in the electronic detection stage by optimizing the electronic detection line in the related technology, can effectively detect the line abnormity of the multi-splitter circuit, the source electrode signal line and the fan-out area, avoids the process of the defective products flowing to the back section, reduces the productivity waste and saves the material cost.

According to some embodiments of the present disclosure, referring to FIG. 3, in order to facilitate routing, routing directions of the lighting data lines and the source signal line leads should be determined so as not to affect routing of other design lines. Directions of the lighting data lines and the source signal line leads are not particularly limited, and for example, a direction pointing to a lighting pad (not shown in the drawing) from the bonding region 200 is a first direction, at least one lighting data line extends in a direction perpendicular to the first direction, and the plurality of source signal line leads extend in the first direction. From this, when display panel shows the product for small-size, like during the wrist-watch, bind the junction that the district corresponds the dial plate and the watchband of wrist-watch, extend along the direction of the first direction of perpendicular to when lighting a lamp data line, when source signal line lead wire extends along the first direction, bind the direction extension of distinguishing that lighting a lamp data line and source signal line lead wire all along the orientation watchband, reduced the regional line quantity of lead lines of dial plate, effectively utilize the arrangement of lead lines in the watchband region.

According to some embodiments of the present disclosure, the number of sub-pixel columns connected to the same multi-splitter circuit is not particularly limited as long as the number of sub-pixel columns connected to the same multi-splitter circuit is greater than 1, for example, the number of sub-pixel columns connected to the same multi-splitter circuit may be 6 or 12.

According to some embodiments of the present disclosure, the emission colors of the sub-pixel columns connected to the same multi-splitter circuit are not particularly limited, for example, the emission colors of the sub-pixel columns connected to the same multi-splitter circuit may be the same. When a plurality of sub-pixel columns of the same emission color are connected to a multi-splitter circuit, the multi-splitter circuit can uniformly control the emission intensity of the plurality of sub-pixel columns connected thereto, so as to detect the color difference between the sub-pixel columns of the same color.

According to some embodiments of the present disclosure, the number of sub-circuits included in the multi-splitter circuit is not particularly limited, for example, the multi-splitter circuit may include a first sub-circuit and a second sub-circuit, where the first sub-circuit may be connected to a plurality of sub-pixel columns in odd columns, and the second sub-circuit may be connected to a plurality of sub-pixel columns in even columns.

According to some embodiments of the present disclosure, the number of the sub-pixel lighting data lines included in the lighting data lines is not particularly limited as long as it is consistent with the kind of the sub-pixel column color of the display area. For example, when the sub-pixel columns of the display region are repeatedly arranged in an RGB format, the sub-pixel lighting data lines of the lighting data lines may include a first lighting data line, i.e., a red lighting data line, a second lighting data line, i.e., a green lighting data line, and a third lighting data line, i.e., a blue lighting data line. When the number of the sub-pixel lighting data lines is consistent with the type of the sub-pixel column color of the display area, the sub-pixel column of at least one color in the display area can emit light simultaneously when the electronic detection is carried out.

Figure 6:
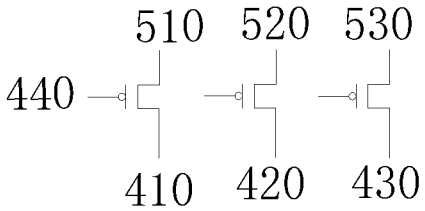
FIG. 6 is a circuit schematic view of a detection circuit according to an embodiment of the present disclosure.

According to some embodiments of the present disclosure, referring to FIGS. 4, 5, and 6, the connection manner of the sub-pixel lighting data lines (such as 410, 420, and 430 shown in the drawings) is not particularly limited, for example, the sub-pixel lighting data lines may be respectively electrically connected to different source signal line leads. For ease of understanding, only two red source signal line leads 510, two green source signal line leads 520, and two blue source signal line leads 530 are shown in FIG. 5 and FIG. 5. When the sub-pixel columns of the display region are repeatedly arranged in the RGB format, the first lighting data line 410 is connected to only the plurality of red source signal line leads 510, the second lighting data line 420 is connected to only the plurality of green source signal line leads 520, the third lighting data line 430 is connected to only the plurality of blue source signal line leads 530, and the source signal line leads of different colors are connected to the multi-splitter circuits of the corresponding colors. The lighting signals transmitted by the lighting pad are transmitted to the corresponding source electrode signal wire leads through the sub-pixel lighting data wires with different colors, the source electrode signal wire leads are connected to the multi-splitter circuit, and the lighting signals are transmitted to the sub-pixel rows through the multi-splitter circuit. Taking the example of the lighting pad emitting the red lighting signal, the red lighting signal is transmitted from the lighting pad to the first lighting data line 410, and is transmitted from the first lighting data line 410 to the red source signal line lead 510, and the red lighting signal is transmitted to the multi-splitter circuit connected to the plurality of red sub-pixel rows through the red source signal line lead 510, and is transmitted to the sources of the plurality of red sub-pixel rows through the source signal line connected to the multi-splitter circuit. That is, at this time, the current passes through the multi-splitter circuit, the source signal line, and the fan-out region, and if an abnormality such as electrostatic burn, short circuit, or disconnection occurs in a line of one or more portions of the multi-splitter circuit, the source signal line, and the fan-out region, the sub-pixel column cannot be lightened by the lighting test, indicating that the abnormality exists.

In order to improve the uniformity of light emission of the same color sub-pixel row in the lighting test, the source signal line lead may further include a thin film transistor.

According to some embodiments of the present disclosure, each of the sub-pixel lighting data lines and the source signal line lead may further include at least one thin film transistor therebetween. The detection circuit realizes the line detection of the multi-splitter circuit, the source signal line and the fan-out area in the electronic detection stage, and can effectively detect the line abnormity of the multi-splitter circuit, the source signal line and the fan-out area. Because the lighting data line has self internal resistance, when the lighting data line transmits lighting signals to the source signal line leads, lighting signals received by the source signal line leads at different positions have difference due to IR drop, and the lighting test display effect shows that the display brightness of the sub-pixel rows with the same color is not uniform. The thin film transistor is arranged between the lighting data line and the source electrode signal line lead, so that the problem of uneven display brightness of the sub-pixel rows with the same color can be effectively solved, where the lighting data line can control the switch of the thin film transistor, the source electrode signal line lead is connected to the source electrode of the thin film transistor, and the drain electrode of the thin film transistor is connected to the multi-splitter circuit, so that the lighting signals which can be output to the multi-splitter circuit through the thin film transistor are kept consistent by controlling the electrical characteristics of the thin film transistor.

According to some embodiments of the present disclosure, referring to FIG. 5, the composition of the thin film transistor is not particularly limited, for example, the thin film transistor may include an active layer 920 and a gate electrode 910. According to some embodiments of the present disclosure, a connection manner of the source and the drain of the thin film transistor is not particularly limited, for example, the source of at least one thin film transistor may be electrically connected to at least one lighting data line, and the drain of at least one thin film transistor may be electrically connected to a plurality of source signal line leads. The connection manner of the active layer of the thin film transistor is not particularly limited, and the active layer of the thin film transistor may be located on the side of the source signal line lead away from the substrate, and the active layer and the source signal line lead may be insulated and spaced by an insulating layer.

According to some embodiments of the present disclosure, the composition of the thin film transistor gate is not particularly limited, for example, the gate of the thin film transistor may include a first gate and a second gate. That is, the thin film transistor may be a double gate type thin film transistor. When the grid electrode of the thin film transistor includes the first grid electrode and the second grid electrode, the thin film transistor has stronger regulation and control capability on the source current, so that the characteristics of the thin film transistor can be regulated and controlled, and the current output by the thin film transistor can be regulated and controlled, therefore, the uniformity of the lighting signal transmitted to the multi-splitter circuit can be further improved, and the uniformity of the lighting signal received by a plurality of sub-pixel columns connected to the multi-splitter circuit can be further controlled.

According to some embodiments of the present disclosure, referring to FIGS. 4, 5, and 6, the composition of the lighting data line is not particularly limited, for example, when one thin film transistor is included between each of the sub-pixel lighting data lines and the source signal line lead, the lighting data line may further include a switch bus 440, and the switch bus 440 is connected to the gates of the plurality of thin film transistors. Therefore, the thin film transistors can be turned on simply and conveniently to realize the test.

According to some embodiments of the present disclosure, referring to FIGS. 4 and 5, positions of the switching buss 440 and the subpixel lighting signal lines (410, 420, and 430 shown in the drawings) are not particularly limited, for example, the switching buss may be positioned at a side of the gates away from the substrate with an insulating medium interposed therebetween, and the switching buss and the gates are connected by vias; the sub-pixel lighting signal line may be positioned at a side of the drain electrode away from the substrate, and an insulating medium is interposed between the sub-pixel lighting signal line and the drain electrode, and the sub-pixel lighting signal line and the drain electrode are connected through a via. When the switch bus and the sub-pixel lighting signal line are positioned at the positions, the space utilization rate of the display panel can be effectively utilized and improved, and transmission interference between layers is avoided. When the switch bus and the sub-pixel point lamp data lines are located at the positions, the space utilization rate of the display panel can be effectively improved, and transmission interference between layers is avoided.

In another aspect of the present disclosure, the present disclosure provides a method for detecting a display panel, where the display panel is the display panel described above, and the method includes: a lighting signal is inputted from a lighting pad to a plurality of source signal lines through a detection circuit. Therefore, the abnormity detection of the source electrode signal line, the multi-splitter circuit and the fan-out area of the display panel which only completes the single display screen preparation process can be directly realized, the detection can be completed without a module process, the detection flow is greatly simplified, and the waste of defective products to module process productivity and materials is reduced.

According to some embodiments of the present disclosure, the kinds of the lighting signals output by the lighting pad are not particularly limited, and for example, the lighting signals may include timing signals as well as switching signals. Therefore, the display area can be displayed with different colors through the change of the lighting signal, and the completeness of detection is ensured.

According to some embodiments of the present disclosure, the lighting data line is not particularly limited in composition, for example, the lighting data line may further include a switch bus and a plurality of sub-pixel lighting data lines, each of which further includes a thin film transistor between the source signal line lead and each of the sub-pixel lighting data lines.

According to some embodiments of the present disclosure, the method for detecting the display panel is not particularly limited, for example, when the lighting data line may further include a switch bus and a plurality of sub-pixel lighting data lines, each of which further includes a thin film transistor between the sub-pixel lighting data line and the source signal line lead, the method for detecting the display panel further includes: the switch bus is inputted with a switch signal to turn on the plurality of thin film transistors, and the lighting signal is inputted to the drain of the thin film transistor through the sub-pixel lighting data line and inputted from the source of the thin film transistor to the source signal line lead. This further improves the uniformity of light emission of each sub-pixel row during detection.

Figure 7:
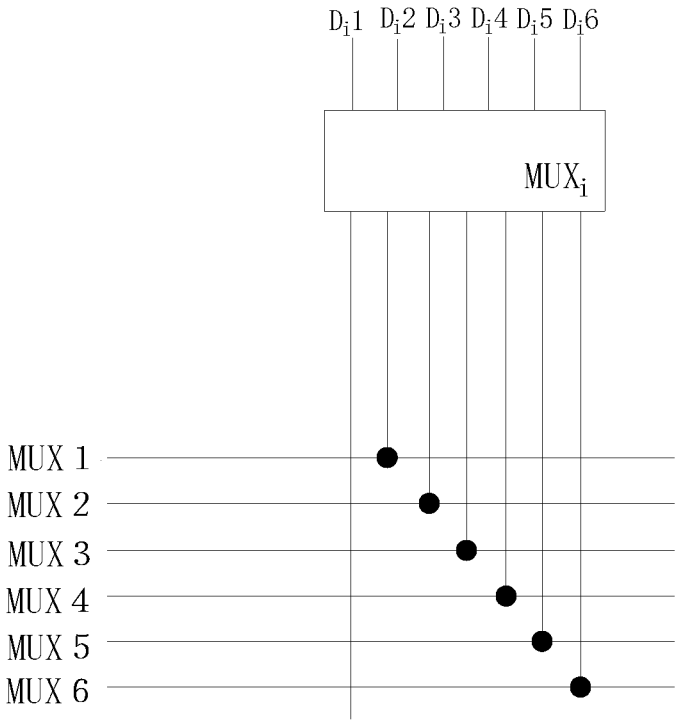
FIG. 7 is a circuit schematic view of a multi-splitter circuit according to an embodiment of the present disclosure.
Figure 8:
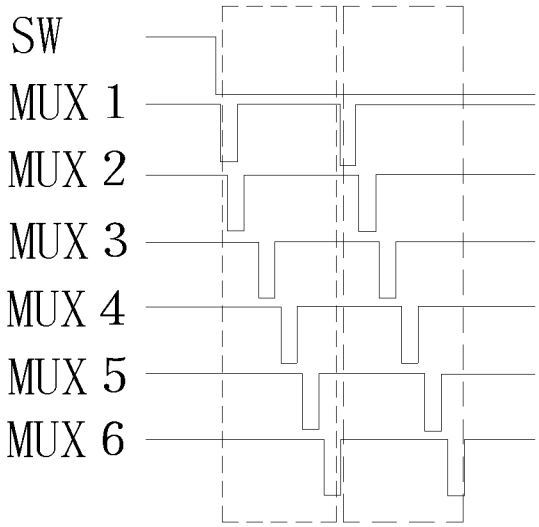
FIG. 8 shows a driving timing diagram of a detection method according to an embodiment of the present disclosure.
Figure 9:
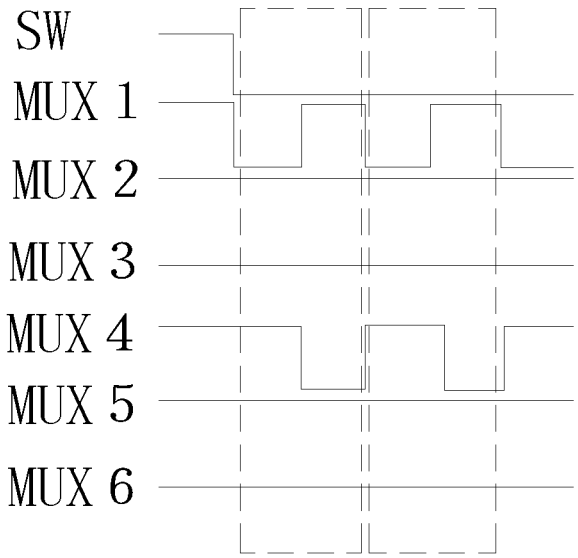
FIG. 9 shows a driving timing diagram of a detection method according an embodiment of the present disclosure.
Figure 10:
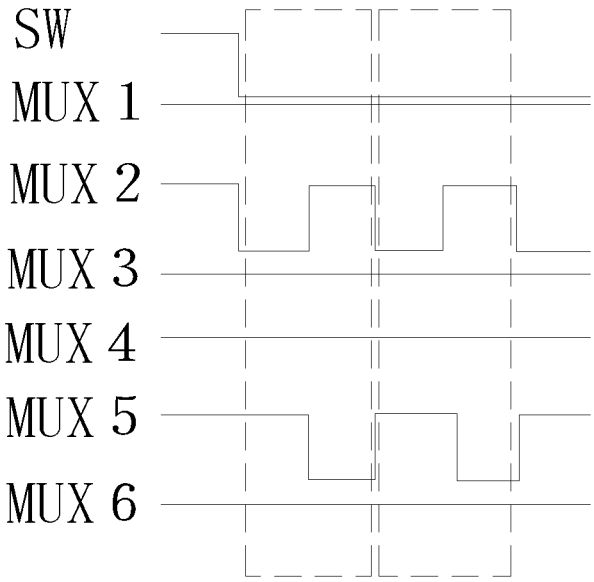
FIG. 10 shows a driving timing diagram of a detection method according an embodiment of the present disclosure.
Figure 11:
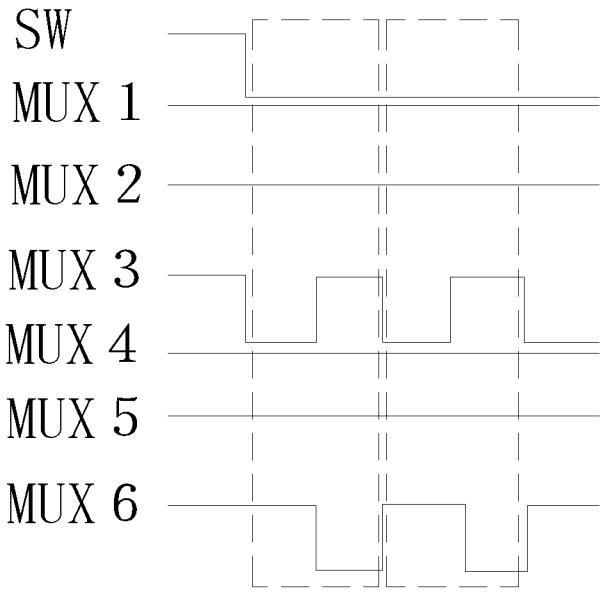
FIG. 11 shows a driving timing diagram of a detection method according an embodiment of the present disclosure.

According to some embodiments of the present disclosure, the circuit design of the multi-splitter circuit is not particularly configured, and for example, may have a structure as shown in FIG. 7, MUX1-6 are 6 multi-splitter circuits, respectively, and Di1-Di6 are connected to six source signal lines, respectively. Referring to FIG. 8-11, taking the example that the sub-pixel columns include three sub-pixel columns of red, green and blue, and the number of sub-pixel columns connected to the same multi-splitter Module (MUX) is 6, the driving timing of the method for detecting the display panel is shown in the figure, SW is a switch bus, and the thin film transistor is turned on at a low level. MUX1-6 is 6 multi-splitter circuits, where MUX1-3 is the first sub-circuit, MUX4-6 is the second sub-circuit, MUX1 and MUX4 are connected to 6 red sub-pixel columns, MUX2 and MUX5 are connected to 6 green sub-pixel columns, and MUX3 and MUX6 are connected to 6 blue sub-pixel columns. MUX1-6 is all on low. Specifically, MUX1 is connected to source signal lines of red sub-pixel columns in odd columns, MUX2 is connected to source signal lines of green sub-pixel columns in odd columns, MUX3 is connected to source signal lines of blue sub-pixel columns in odd columns, MUX4 is connected to source signal lines of red sub-pixel columns in even columns, MUX5 is connected to source signal lines of green sub-pixel columns in even columns, and MUX6 is connected to source signal lines of blue sub-pixel columns in even columns.

When the detection circuit does not include a thin film transistor, that is, the lighting data lines include only the first lighting data line, the second lighting data line, and the third lighting data line, the driving timing diagram does not include the SW timing in FIGS. 8 to 11. The following description will be made in detail by taking an example of a test sequence for displaying a red screen, a green screen, a blue screen, and a black/white screen, respectively:

when the red lighting test is performed, the MUX2, the MUX3, the MUX5, and the MUX6 are all kept in the high-level off state, and in the same frame, when the MUX1 is in the low-level on state, the MUX4 is kept in the high-level off state, and when the MUX1 is in the high-level off state, the MUX4 is kept in the low-level on state, so that the red subpixels in the odd columns and the even columns are sequentially lit, and the display of the display panel is red.

Similarly, when the green lighting test is performed, the MUX1, the MUX3, the MUX4, and the MUX6 all keep a high-level off state, and in the same frame, when the MUX2 is low-level on, the MUX5 keeps high-level off, and when the MUX2 is high-level off, the MUX5 keeps low-level on, so that the green sub-pixels in the odd columns and the even columns are sequentially turned on, and the display of the display panel is green.

Similarly, when the blue lighting test is performed, the MUX1, the MUX2, the MUX4, and the MUX5 all keep a high-level off state, and in the same frame, when the MUX3 is low-level on, the MUX6 keeps high-level off, and when the MUX3 is high-level off, the MUX6 keeps low-level on, so that the blue sub-pixels in the odd columns and the even columns are sequentially turned on, and the display of the display panel is blue.

When performing the black or white lighting test, the MUX1-6 is turned on at low level in the same frame. Thereby, the display panel displays black or white.

When the lighting data lines include only the first lighting data line, the second lighting data line, the third lighting data line, and the switch bus, i.e., the thin film transistor is included between the lighting data line and the source signal line lead, the driving timing diagram includes the SW timing shown in FIGS. 8 to 11. The drive timing of the MUX1-MUX6 at the time of the lighting test is identical to the drive timing of the lighting test when no thin film transistor is included, except that the thin film transistor needs to be turned on at a low level to turn on the source signal line lead before the lighting signal is input to the MUX1-MUX 6.

In yet another aspect of the present disclosure, the present disclosure proposes an electronic device, which includes a display panel, the display panel includes a display area and a peripheral region surrounding the display area;

a plurality of bonding pads in the peripheral region;

the lighting pad is in the peripheral region;

a plurality of source signal lines at least in the display region;

a plurality of source signal line leads in the peripheral region and electrically connected to the plurality of source signal lines and electrically connected to the plurality of bonding pads;

a plurality of sub-pixel columns in the display region and electrically connected to the plurality of source signal lines;

the detection circuit is in the peripheral region, positioned between the plurality of binding pads and the display area and symmetrically distributed on two sides of the display area together with the lighting pad;

the detection circuit includes at least one lighting data line which surrounds the display area, extends to the lighting pad and is electrically connected to the lighting pad;

the at least one lighting data line is electrically connected to at least one of the plurality of source signal line leads, and is configured to transmit a lighting signal to the at least one of the plurality of source signal line leads.

Optionally, the electronic device includes: a multi-splitter circuit between the display area and the detection circuit, and electrically connected to at least two of the plurality of source signal lines and one of the plurality of source signal line leads, respectively, the multi-splitter circuit being configured to transmit the lighting signal provided by the source signal line leads to the at least two source signal lines at different periods of time, respectively.

Optionally, a direction from the bonding region to the lighting pad is a first direction, the at least one lighting data line extends in a direction perpendicular to the first direction, and the plurality of source signal line leads extend in the first direction.

Optionally, the multi-splitter circuit includes a first sub-circuit and a second sub-circuit, the first sub-circuit is connected to a plurality of sub-pixel columns in odd columns, and the second sub-circuit is connected to a plurality of sub-pixel columns in even columns.

Optionally, the at least one lighting data line includes a first lighting data line, a second lighting data line and a third lighting data line, the first lighting data line, the second lighting data line and the third lighting data line are respectively electrically connected to different source signal line leads.

Optionally, the electronic device further includes at least one thin film transistor, a source of the at least one thin film transistor is electrically connected to the at least one lighting data line, and a drain of the at least one thin film transistor is electrically connected to the plurality of source signal line leads.

Optionally, the at least one lighting data line further includes a switch bus electrically connected to the gates of the plurality of thin film transistors.

Optionally, the switch bus is located on a side of the gate away from the substrate, an insulating medium is spaced between the switch bus and the gate, and the switch bus and the gate are electrically connected through a via in the insulating medium.

Reference throughout this specification to the description of "one embodiment," "another embodiment," or the like, means that a particular feature, structure, material, or characteristic described in connection with the embodiment is included in at least one embodiment of the present disclosure. In this specification, the schematic representations of the terms used above are not necessarily intended to refer to the same embodiment or example. Furthermore, the particular features, structures, materials, or characteristics described may be combined in any suitable manner in any one or more embodiments or examples. Moreover, various embodiments or examples and features of various embodiments or examples described in this specification can be combined and combined by one skilled in the art without being mutually inconsistent.

While embodiments of the present disclosure have been shown and described above, it will be understood that the above embodiments are exemplary and not to be construed as limiting the present disclosure, and that changes, modifications, substitutions and alterations may be made to the above embodiments by those of ordinary skill in the art within the scope of the present disclosure.

What is claimed is:

1. A display panel, comprising a display area and a peripheral region surrounding the display area;

a plurality of bonding pads in the peripheral region;

a lighting pad in the peripheral region;

a plurality of source signal lines at least in the display region;

a plurality of source signal line leads in the peripheral region and electrically connected to the plurality of source signal lines and electrically connected to the plurality of bonding pads;

a plurality of sub-pixel columns in the display region and electrically connected to the plurality of source signal lines; and a detection circuit, arranged in the peripheral region and between the plurality of binding pads and the display area, wherein the detection circuit and the lighting pad are symmetrically distributed on two sides of the display area;

wherein the detection circuit comprises at least one lighting data line which surrounds the display area, extends to the lighting pad and is electrically connected to the lighting pad;

the at least one lighting data line is electrically connected to at least one of the plurality of source signal line leads, and is configured to transmit a lighting signal to the at least one of the plurality of source signal line leads, wherein the display panel further comprises at least one thin film transistor, wherein a source of the at least one thin film transistor is electrically connected to the at least one lighting data line, and a drain of the at least one thin film transistor is electrically connected to the plurality of source signal line leads, wherein the at least one lighting data line further comprises a switch bus electrically connected to gates of the plurality of thin film transistors, wherein the switch bus is located on a side of the gate away from a substrate, and an insulating medium is interposed between the switch bus and the gate, and the switch bus and the gate are electrically connected through a via in the insulating medium; and wherein the display further comprises a multi-splitter circuit between the display area and the detection circuit, and electrically connected to at least two of the plurality of source signal lines and one of the plurality of source signal line leads, wherein the multi-splitter circuit is configured to transmit the lighting signal provided by the source signal line leads to the at least two source signal lines respectively at different periods of time, wherein the multi-splitter circuit comprises a first sub-circuit connected to the sub-pixel columns in odd columns and a second sub-circuit connected to the sub-pixel columns in even columns.

2. The display panel according to claim 1, wherein a direction pointing from the bonding region to the lighting pad is a first direction, the at least one lighting data line extends in a direction perpendicular to the first direction, and the plurality of source signal line leads extend in the first direction.

3. A method for detecting a display panel according to claim 1, comprising:

inputting a lighting signal from the lighting pad to the plurality of source signal lines through the detection circuit.

4. An electronic device, comprising a display panel;

wherein the display panel comprises a display area and a peripheral region surrounding the display area;

a plurality of bonding pads in the peripheral region;

a lighting pad in the peripheral region;

a plurality of source signal lines at least in the display region;

a plurality of source signal line leads in the peripheral region and electrically connected to the plurality of source signal lines and electrically connected to the plurality of bonding pads;

a plurality of sub-pixel columns in the display region and electrically connected to the plurality of source signal lines; and a detection circuit, arranged in the peripheral region and between the plurality of binding pads and the display area, wherein the detection circuit and the lighting pad are symmetrically distributed on two sides of the display area;

wherein the detection circuit comprises at least one lighting data line which surrounds the display area, extends to the lighting pad and is electrically connected to the lighting pad;

the at least one lighting data line is electrically connected to at least one of the plurality of source signal line leads, and is configured to transmit a lighting signal to the at least one of the plurality of source signal line leads, wherein the display panel further comprises at least one thin film transistor, wherein a source of the at least one thin film transistor is electrically connected to the at least one lighting data line, and a drain of the at least one thin film transistor is electrically connected to the plurality of source signal line leads, wherein the at least one lighting data line further comprises a switch bus electrically connected to gates of the plurality of thin film transistors, wherein the switch bus is located on a side of the gate away from a substrate, and an insulating medium is interposed between the switch bus and the gate, and the switch bus and the gate are electrically connected through a via in the insulating medium; and wherein the display panel further comprises a multi-splitter circuit between the display area and the detection circuit, and electrically connected to at least two of the plurality of source signal lines and one of the plurality of source signal line leads, wherein the multi-splitter circuit is configured to transmit the lighting signal provided by the source signal line leads to the at least two source signal lines respectively at different periods of time, wherein the multi-splitter circuit comprises a first sub-circuit connected to the sub-pixel columns in odd columns and a second sub-circuit connected to the sub-pixel columns in even columns.

5. The electronic device according to claim 4, wherein a direction pointing from the bonding region to the lighting pad is a first direction, the at least one lighting data line extends in a direction perpendicular to the first direction, and the plurality of source signal line leads extend in the first direction.

* * * * *